US007748170B1

(12) United States Patent
Pratt

(10) Patent No.: US 7,748,170 B1
(45) Date of Patent: Jul. 6, 2010

(54) BULKHEAD FLOOR DRAIN

(76) Inventor: James M. Pratt, P.O. Box 920624, Needham, MA (US) 02492-0007

( * ) Notice: Subject to any disclaimer, the term of this patent is extended or adjusted under 35 U.S.C. 154(b) by 712 days.

(21) Appl. No.: 11/724,661

(22) Filed: Mar. 16, 2007

(51) Int. Cl.
*E04D 13/00* (2006.01)

(52) U.S. Cl. ..... 52/11; 52/12; 52/13; 52/14; 52/15

(58) Field of Classification Search ..... 52/11–15; 404/2–5, 118–123; 210/163–166
See application file for complete search history.

(56) References Cited

U.S. PATENT DOCUMENTS

| | | | | | |
|---|---|---|---|---|---|
| 4,185,429 | A * | 1/1980 | Mendola | 52/274 |
| 4,235,008 | A * | 11/1980 | Meredith | 29/428 |
| 4,815,888 | A * | 3/1989 | Stegmeier | 404/4 |
| D312,696 | S * | 12/1990 | Phillips | D25/35 |
| 5,454,663 | A * | 10/1995 | Stegmeier | 404/2 |
| 5,529,436 | A * | 6/1996 | Meyers | 405/119 |
| 5,729,937 | A * | 3/1998 | Mantelli | 52/220.5 |
| 6,129,838 | A * | 10/2000 | Millner | 210/164 |
| 6,612,780 | B2 * | 9/2003 | Dahowski et al. | 405/118 |
| 7,066,685 | B2 * | 6/2006 | Humphries et al. | 405/43 |
| 7,246,472 | B2 * | 7/2007 | Nielsen | 52/302.3 |
| D579,531 | S * | 10/2008 | Musser | D23/261 |
| 7,588,392 | B2 * | 9/2009 | Wroblewski et al. | 405/118 |
| 7,637,694 | B1 * | 12/2009 | Musser | 405/118 |
| 2008/0190045 | A1 * | 8/2008 | Janesky | 52/169.5 |

* cited by examiner

*Primary Examiner*—Richard E Chilcot, Jr.
*Assistant Examiner*—Mark R Wendell
(74) *Attorney, Agent, or Firm*—William Nitkin

(57) ABSTRACT

A bulkhead floor drain for positioning in the basement floor at the base of bulkhead stairs, such bulkhead floor drain extending beyond each side of the width of such bulkhead stair opening. The bulkhead floor drain has a top cover member and a lower channel duct positioned thereunder, such top cover member having a plurality of diagonal slots defined therein for passage therethrough of water and debris coming down said bulkhead stairs and falling into the lower channel duct, such bulkhead floor drain to direct such water to drainage areas to prevent water from flowing further onto the basement floor.

6 Claims, 3 Drawing Sheets

BULKHEAD FLOOR DRAIN

BACKGROUND OF THE INVENTION

1. Field of the Invention

The device of this invention resides in the area of floor drains, and more particularly relates to a structure that acts as a drain in front of bulkhead stairs in a basement, such drain having a duct with a grate thereover.

2. History of the Prior Art

A significant water drainage problem can occur in basements at the base of the bulkhead stairs which lead down into a basement. Water and debris falling through the bulkhead and surrounding structures can come down the stairs and accumulate at the base of the stairs on the floor. It is known in the art to have drain structures around the perimeters of basement floors, but these do not extend in front of the bulkhead stairs on the inside of the basement foundation wall.

SUMMARY OF THE INVENTION

It is an object of this invention to provide a bulkhead floor drain that is located flush with the basement floor directly at the base of bulkhead stairs on the inside of the basement foundation wall so that any water coming through the bulkhead door and surrounding structure and flowing down the stairs will enter the drain of this invention before it gets into the actual basement and will be carried away to another pipe or sump area to prevent accumulation on the basement floor. The structure of this invention consists of an elongated bulkhead floor drain having a lower channel duct and a top cover member which is approximately 4-5 inches in width, but for some uses can be wider or narrower, and of a length which is adjustable depending upon the width of the opening in the foundation provided for the bulkhead stairs. One cuts the bulkhead floor drain of this invention to size to be of a length of approximately the same as the width of the bulkhead foundation opening plus an additional 2 inches on each side. The cut-to-size structure is then installed in a hole or trough dug on the inside of the foundation wall adjacent to the bulkhead opening. Since the bulkhead floor drain of this invention touches the foundation wall, no water coming in from the bulkhead can get by the bulkhead floor drain. The bulkhead floor drain of this invention includes a lower channel duct which is substantially U-shaped in cross-section, and has first and second channel side walls which channel side walls are interconnected by a bottom member. One of the first or second channel side walls can have apertures formed therein, but some embodiments can be solid with no apertures in them. Within the first and second channel side walls, respectively, are first and second catch members which act to catch the downwardly extending first and second arms of the top cover member which first and second arms are inserted, respectively, within the first and second channel side walls, such top cover member being of a width for its arms to fit snugly therein and which top cover member has a plurality of diagonal slots defined therein for water and debris to fall therethrough into the lower channel duct. It has been found that providing slots that are diagonal to the first and second channel side walls allows water and debris, which are flowing directly across the top of the bulkhead floor drain structure of this invention, to pass thereover with less chance of blocking a slot or getting into the trough since they pass over only a narrow segment of each diagonal slot than if the slots were formed perpendicular to the length of the unit where the water and debris would be constantly entering into such slots across their entire lengths. The diagonal slots are positioned along the length of the bulkhead floor drain except at each end where an aperture is provided, as described below. The structure of this invention can have an end cap at each end or, in some embodiments, only one end cap can be utilized with the other end connected to a drain pipe leading, for example, to a sump pump. The top cover member can be easily lifted out of the lower channel duct for removal of any debris collected therein.

DESCRIPTION OF THE PREFERRED EMBODIMENT(S)

Figure 1:
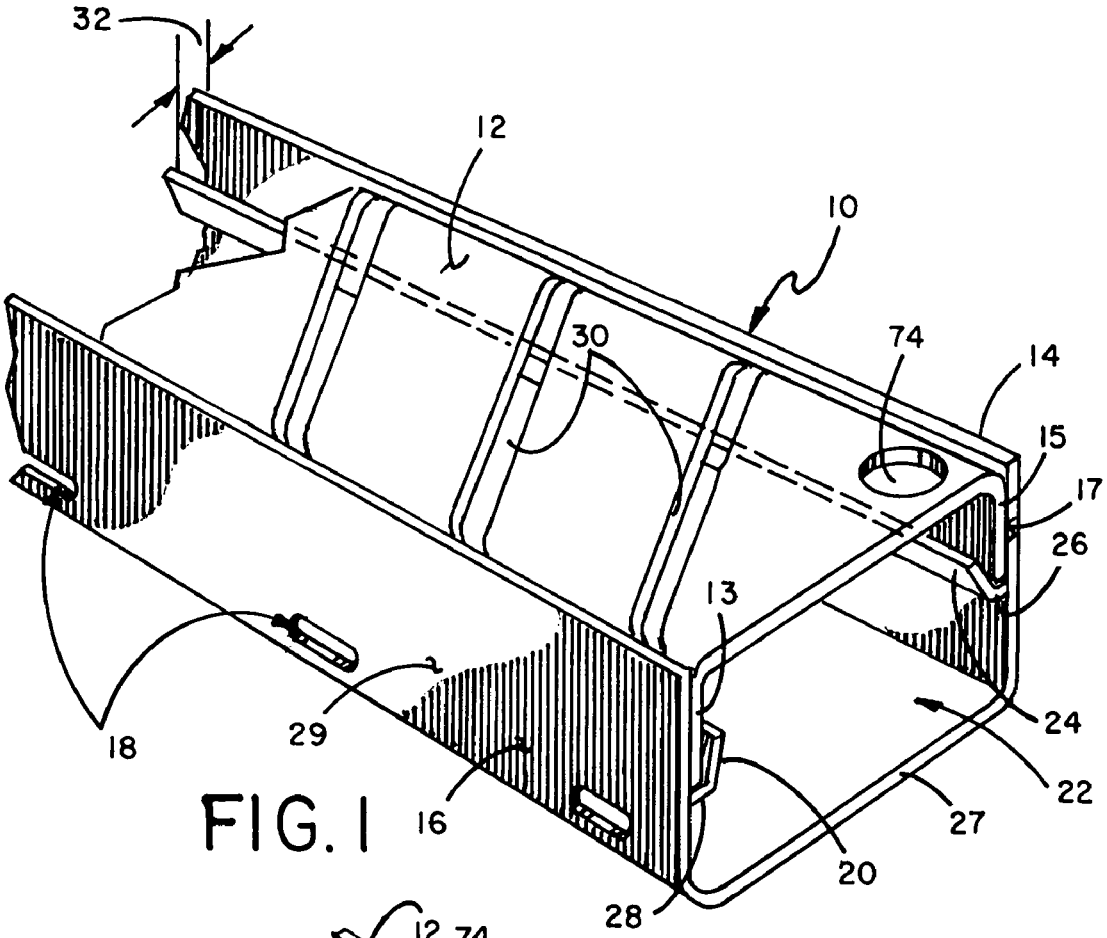
FIG. 1 illustrates a front perspective view of a section of the Bulkhead Floor Drain of this invention.
Figure 3:
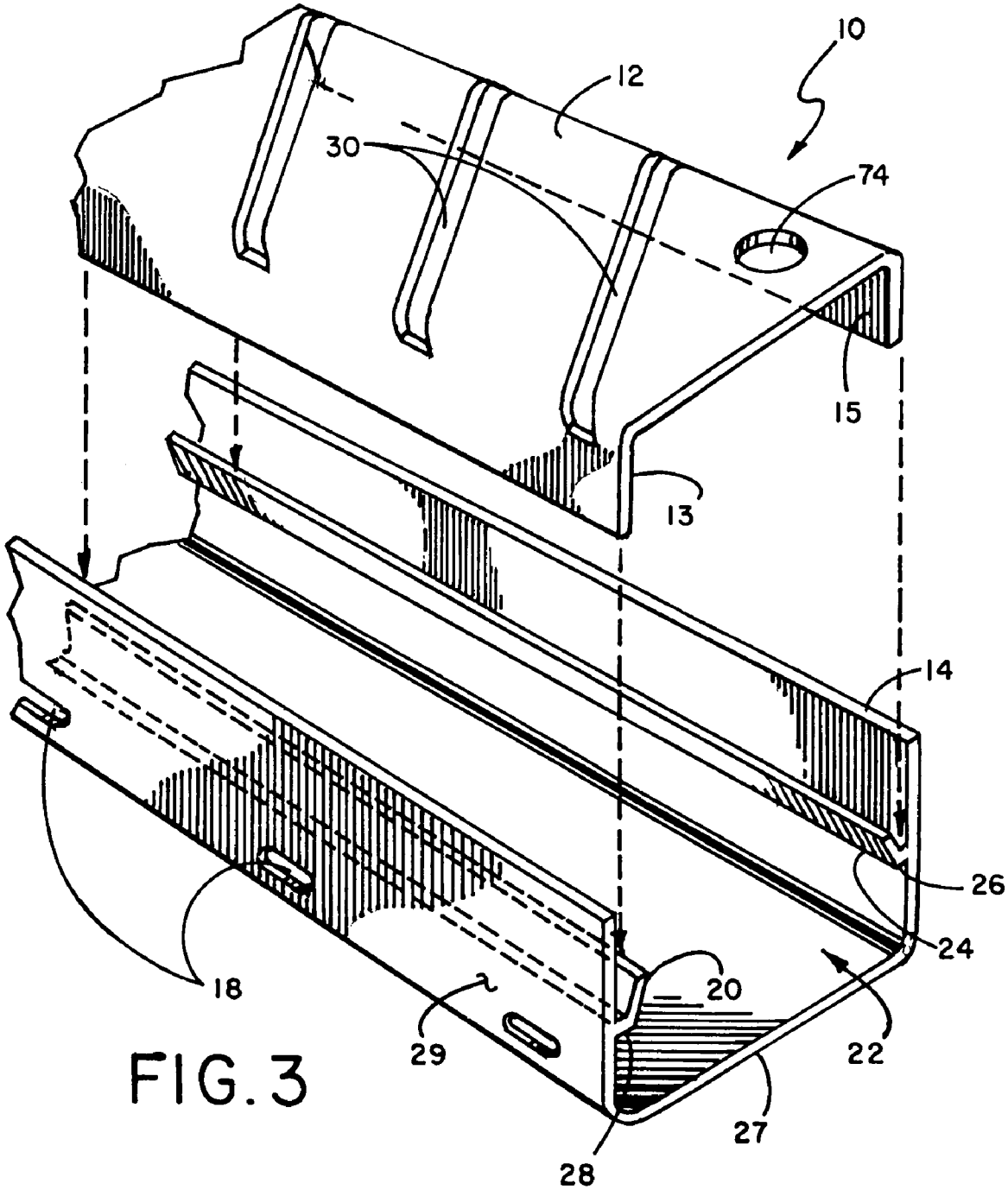
FIG. 3 illustrates a perspective view of a section of the device of this invention, showing the top cover member separated from the lower channel duct.
Figure 4:
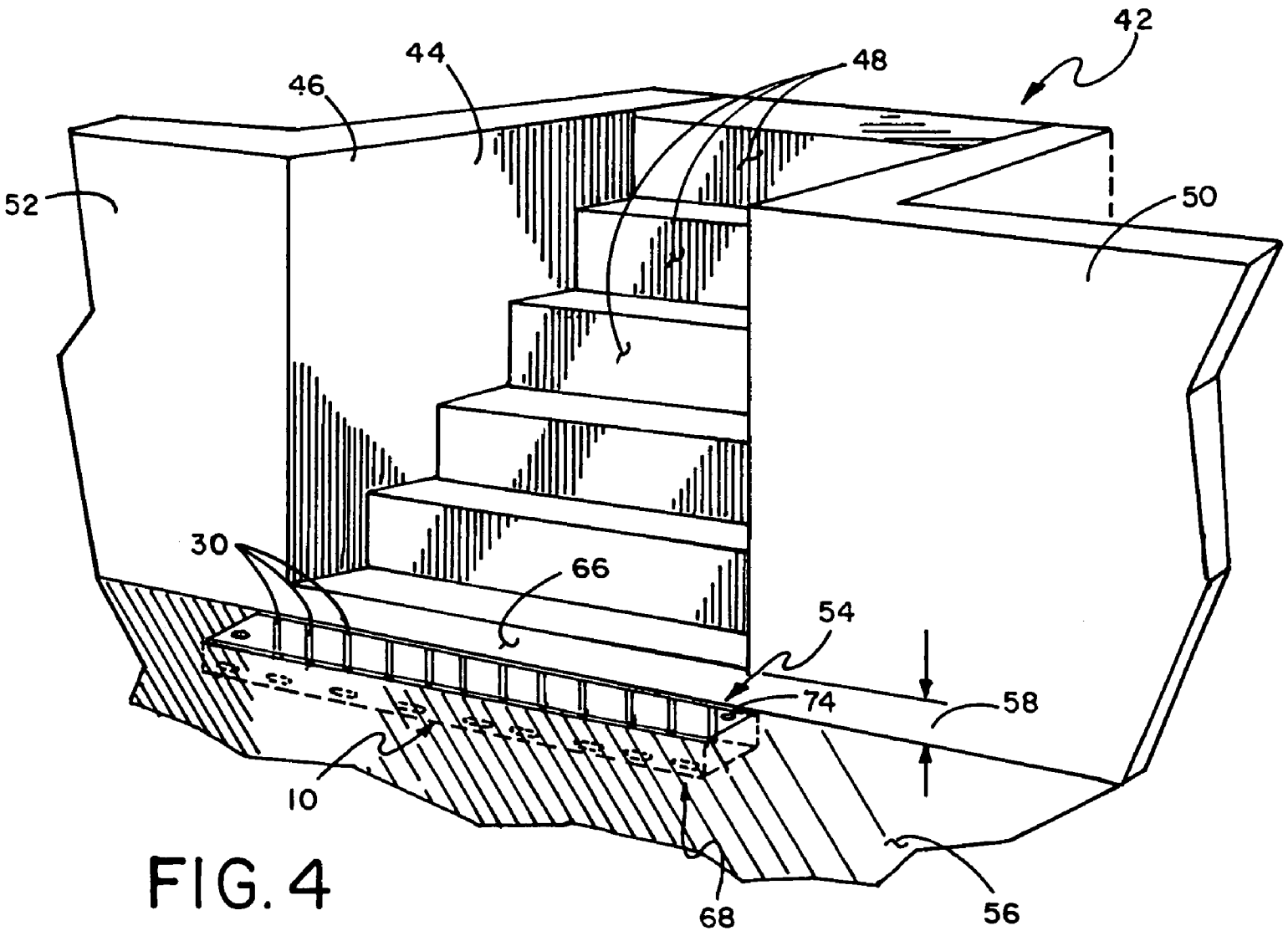
FIG. 4 illustrates a perspective view of a section of a basement, showing the bulkhead stairs with the device of this invention installed at the base thereof.

FIG. 1 illustrates a front perspective view of a section of the bulkhead floor drain 10 of this invention which has basically two component parts, the first being the top cover member 12 which, as seen in FIG. 3, is shown lifted out of lower channel duct 14. The structure can have a width within the range of 4-5 inches and is of a length that is determined to be approximately the horizontal width of the basement bulkhead stairs 48, as seen in FIG. 4. Bulkhead floor drain 10 can be produced or manufactured in long sections of plastic and can be cut to a suitable length to approximate the width of the bulkhead stairs 48 plus about 2 inches more on each side for installation within basement floor 56, as seen in FIG. 4, at the base 54 of the bulkhead stairs. The foundation wall 66, connected to first foundation side wall 50 and second foundation side wall 52, extends at the bottom of stairs 48 behind bulkhead floor drain 10 of this invention and forms part of the foundation of the building.

As seen in FIG. 1 top cover member 12 which has a plurality of diagonal slots 30 formed therein at approximately 45 degrees to the length of bulkhead floor drain 10. Each slot is approximately 3/16 inch wide, and the slots can be disposed approximately 1-3 inches apart from each other and are formed along top cover member 12 to near first and second ends 68 and 70 where top cover member 12 is solid except for first and second apertures 74 and 72, each having a diameter of approximately ½ inch. First aperture 74 is defined at first end 68, and second aperture 72 is defined at second end 70. First and second apertures 74 and 72 allow water to pass therethrough while at the same time allow first and second ends 68 and 70 to be strong enough to be walked on. Extending downward from the top of top cover member 12 are downwardly extending first arm 13 and second arm 15. First arm 13 and second arm 15 of top cover member 12 are separated from each other by a distance to fit snugly, respectively, within the distance between first channel side wall 16 and second channel side wall 17 of lower channel duct 14 and extend downward therebetween and then be stopped so that top cover member 12 is disposed at a height substantially parallel to the top of the first channel side wall 16 and second channel side wall 17. As seen in FIG. 1 first catch member 21 and second catch member 23, respectively, stop first arm 13 and second arm 15 from further downward movement between the first channel side wall 16 and second channel side wall 17 which, respectively, have their first catch member base 28 and second catch member base 26 disposed at a height so as to cause top cover member 12 to be disposed at the top of the lower channel duct 14 substantially in planar alignment with the top surface of first channel side wall 16 and second channel side wall 17. First catch member side 20 extending upward from first catch member base 28 helps direct and retain first arm 13 against the inside of first channel side wall 16. In the same way second catch member side 24 extending upward from second catch member base 26 helps direct and retain second arm 15 against the inside of second channel side wall 17. In this way the device of this invention forms a unit that will accept water and debris through slots 30 defined in top cover member 12 which water and debris will fall within lower channel duct 14 of the device. In one embodiment, as seen in FIGS. 1 and 3, a plurality of drain apertures 18 are defined in first channel side wall 16 which is disposed away from bulkhead stairs 48 to allow water to drain into material surrounding lower channel duct 14. No apertures are defined in second channel side wall 17 that is adjacent to the stairs and foundation wall 66. In some embodiments no drain apertures 18 would be required as the water collected would travel to at least one end of the bulkhead floor drain to be directed through drain pipes, which pipes are well known in the art, to a sump or other water collection area to help keep a basement dry. A plurality of ridges 29, as seen in FIG. 1, can be formed in the outer side of first channel side wall 16 and second channel side wall 17 in order to help grip onto the cement of foundation floor 56 to better retain the lower channel duct securely within the basement floor whether such floor is formed of dirt or of cement and the like so that the bulkhead floor drain cannot be lifted out of position when one lifts top cover member 12 up out of the lower channel duct 14 for debris removal purposes. Although ridges are illustrated in FIG. 1, other protrusions of other shapes can be utilized to accomplish improved retention of the device within the basement floor. The horizontal ridges on second channel side wall 17 cannot be seen in FIG. 1.

Figure 2:
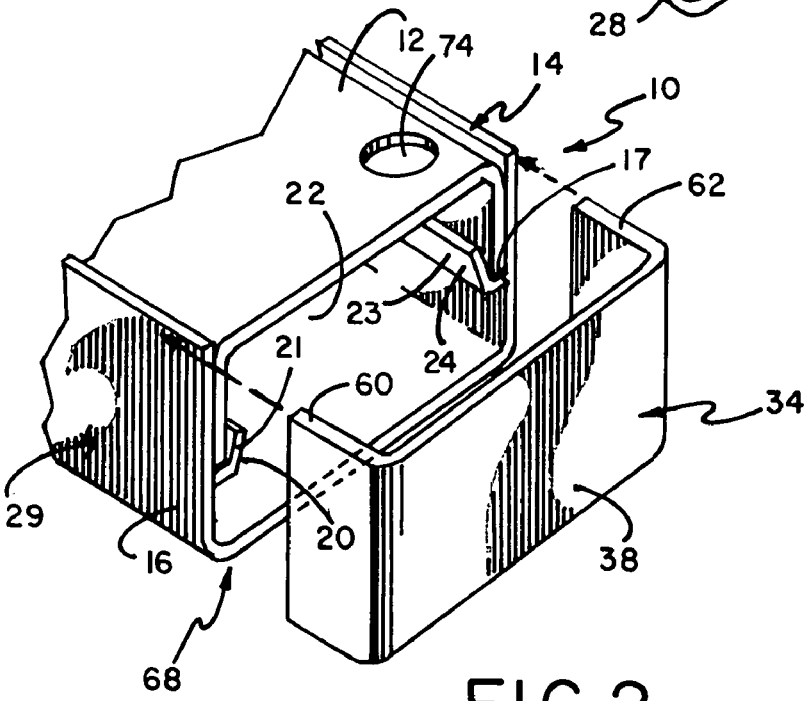
FIG. 2 illustrates a perspective sectional view of one end of the device of this invention, showing an end cap being inserted therearound.

In some embodiments an end cap can be installed at one or both ends of the device of this invention. As seen in FIG. 2, end cap 34 is about to be installed around first end 68 of bulkhead floor drain 12. End cap 34 has wall 38 and first and second end cap side members 60 and 62 with first end cover 40 and second end cover extending, respectively, perpendicularly thereto so that the portion of the end cap that is installed around first and second channel side walls 16 and 17 at the first end 68 of the bulkhead floor drain does not allow water to pour out from first end 68. No end caps are shown installed at first and second ends 68 and 70 in FIG. 4.

Although the present invention has been described with reference to particular embodiments, it will be apparent to those skilled in the art that variations and modifications can be substituted therefor without departing from the principles and spirit of the invention.

I claim:

1. A bulkhead water drain for drainage of water, comprising:

a lower channel duct for positioning in the material of the floor of a basement directly on the inside of the foundation wall at the base of bulkhead opening in front of the stairs leading into said basement, said lower channel duct having a bottom member having first and second sides, first and second ends, a length, and first and second channel side walls extending upward, respectively from said first and second sides of said bottom member along the length of said bottom member, each of said channel side walls having a top, a length, an inner side and an outer side, the distance between said first and second ends of said lower channel duct defining the length of said lower channel duct, the distance between said inner sides of said first and second channel side walls defining the inner width of said lower channel duct;

a top cover member having a top having first and second sides, a length, first and second ends, first and second arms extending downward, respectively, from said first and second sides of said top along said length, each of said first and second arms having a base, a length, an inner side and an outer side, said top cover member having first and second ends, the distance between said first and second ends defining the length of said top cover member, said first and second arms extending the length of said top cover member, said length of said top cover member being approximately the same as the length of said lower channel duct, said top cover member being of a width to fit snugly between said inner sides of said first and second channel side walls when said top cover member is inserted within said first and second channel side walls of said lower channel duct and forming a first opening at said first end and a second opening at said second end, said top cover member being removable from said lower channel duct for easy cleaning of said lower channel duct:

a plurality of slots defined in said top of said top cover member for passage of water and debris therethrough, said plurality of slots extending a distance up to, but not including, said first and second ends of said top cover member along said length of said top cover member;

wherein said plurality of slots defined in said top of said top cover member are each disposed at approximately a 45 degree angle to said length of said top cover member, each of said slots being approximately 3/16 inch wide and spaced approximately 1-3 inches apart from one another; and further including first and second apertures, each having a diameter of approximately ½ inch, said first and second apertures defined, respectively, in said top cover member at said first and second ends thereof.

2. The bulkhead water drain of claim 1 further including means to stop the downward movement of said top cover member within said lower channel duct.

3. The bulkhead water drain of claim 2 wherein said means to stop the downward movement of said top cover member within said lower channel duct comprises first and second catch members extending, respectively, from said inner sides of said first and second channel side walls, each of said first and second catch members formed of an inwardly extending catch member base and an inwardly extending catch member side extending upwardly from said catch member base.

4. The bulkhead water drain of claim 3 further including a plurality of drain apertures defined in at least one channel side wall for dispersion of water into said material of the floor of said basement surrounding said bulkhead water drain.

5. The bulkhead water drain of claim 4 further including a plurality of ridges formed on said outer sides of said first and second channel side walls for promoting adherence to said material surrounding said bulkhead water drain.

6. The bulkhead water drain of claim 5 further including at least one end cap for positioning around at least one of said first and second ends of said bulkhead water drain.

* * * * *